US006614357B1

(12) United States Patent
Gibson et al.

(10) Patent No.: US 6,614,357 B1
(45) Date of Patent: Sep. 2, 2003

(54) MINIATURE MESSAGE MODULE

(75) Inventors: Donald F. Gibson, Billerica, MA (US); Mark R. Gibson, Billerica, MA (US)

(73) Assignee: Support Systems Product Development Corporation, Billerica, MA (US)

( * ) Notice: Subject to any disclaimer, the term of this patent is extended or adjusted under 35 U.S.C. 154(b) by 0 days.

(21) Appl. No.: 09/543,493

(22) Filed: Apr. 6, 2000

Related U.S. Application Data

(60) Provisional application No. 60/128,319, filed on Apr. 8, 1999.

(51) Int. Cl.[7] ..... G08B 25/08
(52) U.S. Cl. ..... 340/692; 340/457; 340/384.1
(58) Field of Search ..... 340/692, 457, 340/384.1, 384.5; 434/185

(56) References Cited

U.S. PATENT DOCUMENTS

| | | | | | |
|---|---|---|---|---|---|
| 3,634,885 | A | * | 1/1972 | Barkley | 340/279 |
| 3,866,204 | A | * | 2/1975 | Barkley | 340/279 |
| 4,677,657 | A | * | 6/1987 | Nagata et al. | 349/63 |
| 5,266,034 | A | * | 11/1993 | Mitz | 434/185 |
| 5,484,316 | A | * | 1/1996 | Poirier | 446/28 |
| 5,644,296 | A | * | 7/1997 | Miller | 240/573 |
| 5,701,341 | A | * | 12/1997 | Kuo | 349/433 |
| 5,721,537 | A | * | 2/1998 | Protas | 340/825.44 |
| 5,748,096 | A | * | 5/1998 | Kaufer | 340/686 |
| 5,860,065 | A | * | 1/1999 | Hsu | 704/270 |

OTHER PUBLICATIONS

"Support Systems Product Development Corporation (SSPDC)", Marketing Brochure, (1999, Jan. 3).

"Product Patrol—The latest advances in equipment and service," *POLICE The Law Enforcement Magazine*, p. 1 (1999, Mar. 1).

"Safety Badges," *Family Circle*, p. 12 (2000, Feb. 1).

Schorow, S., "Extra protection," *The Boston Herald*, pp. 35 (1999, Jul. 6).

Tutalo, F., "Some Extra Protection Behind Their Shields," *The Lowell Sun*, pp. 1, 5 (1999, Oct 19).

Eager, K., "Police welcome first–of–a–kind medical badges," *Boston Sunday Globe*, pp. 1, 4 (1999, Jul. 25).

* cited by examiner

*Primary Examiner*—Benjamin C. Lee
*Assistant Examiner*—Phung Nguyen
(74) *Attorney, Agent, or Firm*—Hamilton, Brook, Smith & Reynolds, P.C.

(57) ABSTRACT

An annunciator device operable to record and store a message can be disposed in close proximity to a user for playback of the message if the user becomes incapacitated or otherwise unable to respond. The annunciator device includes an actuator or button to initiate recording or playback of the message. A mode selector switch determines whether recording or playback will occur. Once recorded, the message is stored in a memory and can be broadcast to others by triggering the actuator to initiate playback. The stored message can contain information such as name, address, medical conditions, persons to contact, and other information which may assist emergency personnel, bystanders, and others in providing appropriate care and attention should the user become incapacitated or unable to respond.

25 Claims, 5 Drawing Sheets

MINIATURE MESSAGE MODULE

RELATED APPLICATION(S)

This application claims the benefit of U.S. Provisional Patent Application No. 60/128,319, filed Apr. 8, 1999, entitled "Miniature Message Module," the entire teachings of which are incorporated herein by reference.

BACKGROUND OF THE INVENTION

Medical profile information storage apparatus and methods are known which retain information pertinent to emergency care should the need arise. Such information includes name, address, persons to contact, allergies, medications, and other medical conditions and alerts which may be helpful to emergency personnel, bystanders, and others in providing appropriate care. Several prior art systems and methods are known which are typically employed to store such medical profile information. An "emergency contact" sheet is often kept on file by an employer, school, or other institution affiliated with an individual. "Medic alert" bracelets are often worn to indicate particular medical conditions, such as diabetes or heart disease, by having a message printed thereon. Active transmission devices allow a victim to send a signal or voice message to a remote receiving station from which assistance can be dispatched.

Typical prior art apparatus and methods, however, may not be adequate to provide timely, accurate, and sufficient information in a medical emergency. An information sheet kept on file may not be readily accessible if the victim is off site, and is prone to staleness. A bracelet may not be seen by a care provider, and is limited in the amount of information that can be printed thereon. A user must be coherent to activate a transmission device, and these devices may be forgotten by a user altogether and therefore not within the user's control.

It would be beneficial, therefore, to provide a system which can be stored or worn in close proximity to a user, which can store a message having a sufficient quantity of information about a victim, to allow the message to be readily recalled by assisting personnel even if the user is passive, to maintain the message throughout prolonged periods of non-use, and which can be easily updated as pertinent information changes.

SUMMARY OF THE INVENTION

An annunciator device operable to record and store a message can be disposed in close proximity to a user for playback of the message if the user becomes incapacitated or otherwise unable to respond. The annunciator device includes an actuator or button to initiate recording or playback of the message. A mode selector switch determines whether recording or playback will occur. Once recorded, the message is stored in a memory and can be broadcast to others by triggering the actuator to initiate playback. The stored message can contain information such as name, address, medical conditions, persons to contact, and other information which may assist emergency personnel, bystanders, and others in providing appropriate care and attention should the user become incapacitated or unable to respond.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows. A personal annunciator device can be adapted to be stored in a variety of housings for recall by assisting personnel. A message can be recorded by a user, stored in a battery maintained memory in the annunciator device, and recalled by pressing a button, or actuator, to initiate playback of the message. A mode selector determines whether record or playback will occur, and prevents unintended erasing of the message. The message can be of various lengths, depending on the size of the memory, and is replayed as necessary by the assisting personnel by repressing the button. In a preferred embodiment, the memory is an EEPROM (electronically erasable programmable read-only memory), providing longevity of the message and tolerance to battery failure. The device can be worn by a user in a predetermined manner, such as behind a badge or ID card, so that emergency personnel are informed as to how to retrieve the message.

Figure 1:
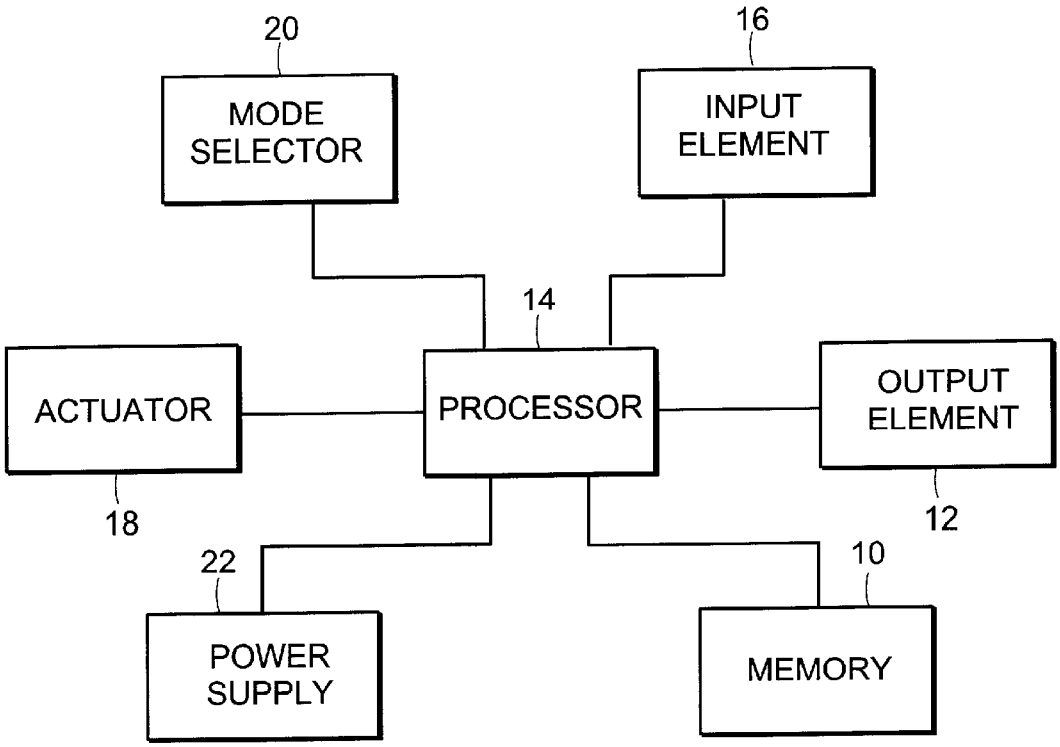
FIG. 1 shows a block diagram of the present invention.

Referring to FIG. 1, a block diagram of the invention as defined herein is shown. A memory 10, such as an EEPROM, stores a message which can be replayed on demand. An output element 12, such as a speaker, broadcasts the message to assisting personnel. A processor 14 retrieves the message from the memory 10 and sends it to the output element 12. An input element 16, such as a microphone, is used to record the message by receiving a message spoken by a user and sending it to the processor 14 for storage in the memory 10. An actuator 18, such as a momentary contact button or switch, commences record or broadcast playback of the message as determined by a mode selector 20. The mode selector 20 has at least two positions to indicate whether record or playback is to occur when the actuator is pressed. The memory is maintained by a power supply 22, such as one or two batteries, and is resilient to momentary fluctuation in power, as occurs when the batteries are changed. In a preferred embodiment, only one battery is needed to maintain the memory and the second battery is a backup.

Figure 2:
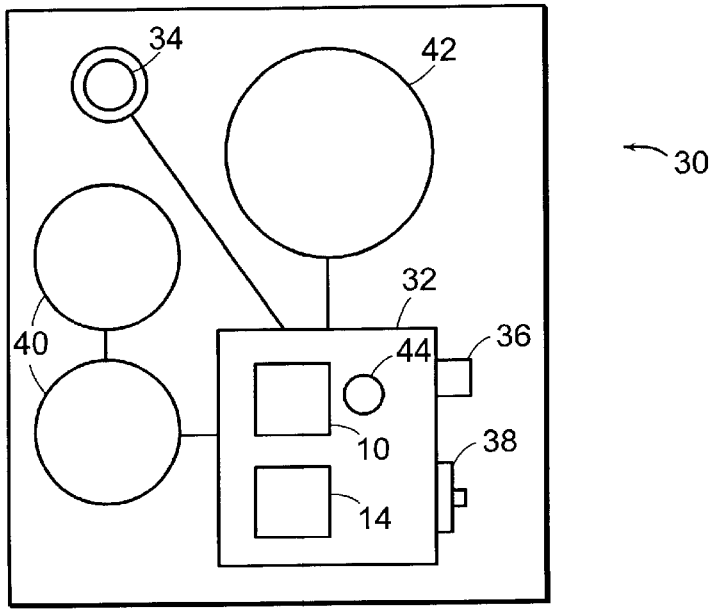
FIG. 2 shows a circuit board layout of a preferred embodiment of the present invention.

FIG. 2 shows a circuit board layout of the annunciator device 30. A circuit board 32 is used to mount a memory 10, a processor 14, a microphone 36, and a mode selector switch 38. An actuator button 34 is connected to the circuit board and is depressed to start the record and playback operations. The mode selector switch 38 determines whether a record or playback operation will be initiated by the actuator button 34. The processor 10 stores and retrieves the message from memory, depending on the position of the mode selector switch 38. During a record operation, a message spoken by a user is received by the microphone 36, and converted into annunciator signals. The annunciator signals are received by the processor 14 and stored in the memory 10. The circuit is powered and the memory 10 maintained by batteries 40. During a playback operation, the annunciator signals are retrieved from the memory 10 by the processor 14 and sent to a speaker 42. The speaker 42 receives the annunciator signals and produces the audible message. Also included on the circuit board is a record indicator LED 44, which is illuminated during a record operation to indicate that the memory 10 is being overwritten.

Figure 3:
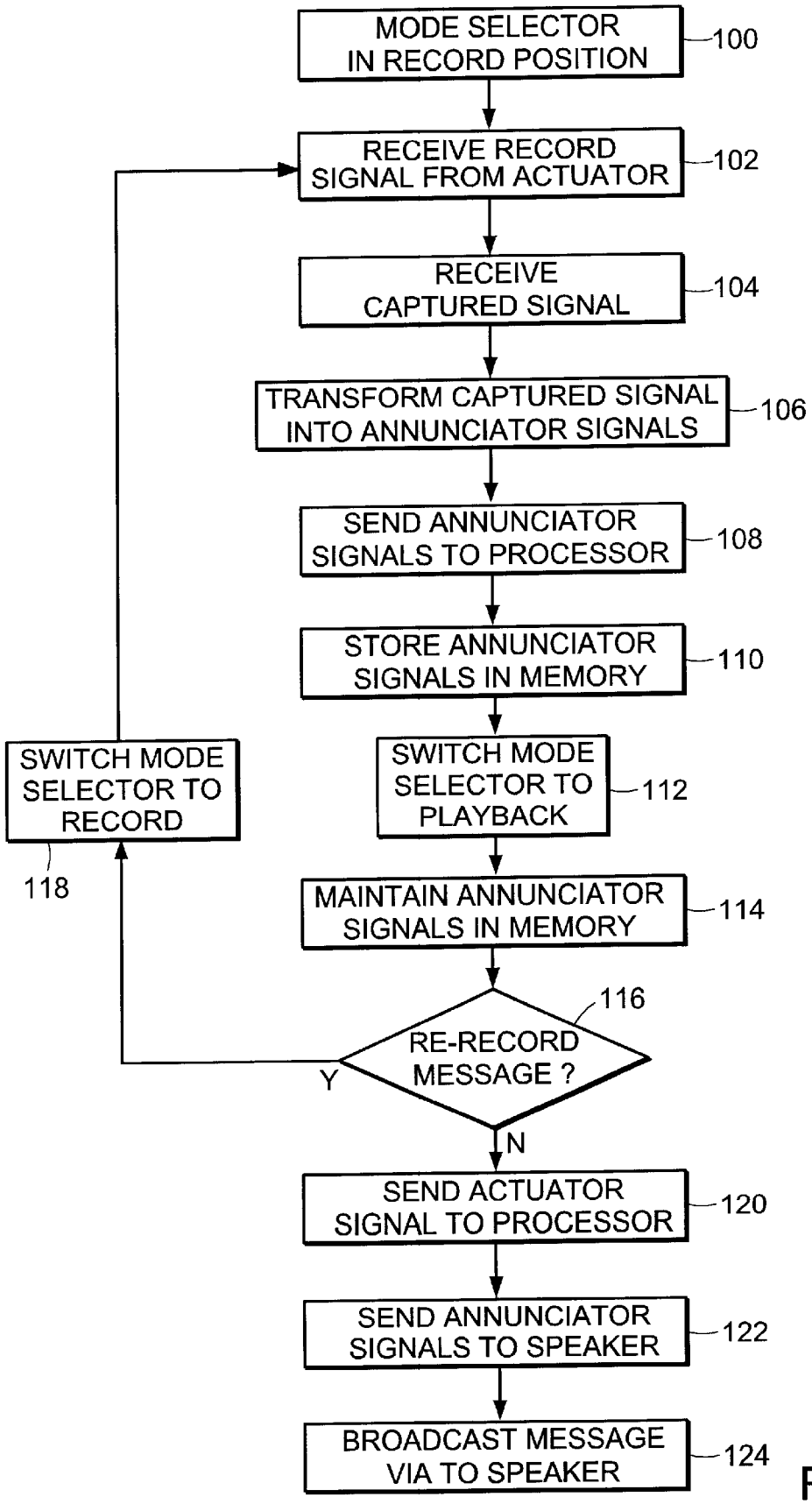
FIG. 3 shows a flowchart depicting the operation of the invention as defined herein.

Referring to FIG. 3, the sequence performed by a user to provide a message using the annunciator device will be described. In an initial state, the mode selector switch is in a record position, as shown at step 100. A record signal is sent from the user by depressing the actuator button, as depicted at step 102. A message spoken by a user is received as a captured signal by the microphone, as shown at step 104. The captured signal is transformed into annunciator signals by the microphone, as disclosed at step 106. The annunciator signals are sent to the processor, as depicted at step 108. The processor stores the annunciator signals in memory, as shown at step 110. After recording the message, the user switches the mode selector switch to the playback position, as depicted in step 112. The signals are maintained in the memory by the power supply until a message is to be recalled or recorded over, as disclosed at step 114. The user may elect to re-record the message and overwrite the memory with a new message, as shown at step 116. If a user decides to re-record the message, the mode selector switch is changed from the playback position to the record position, as shown at step 118. A record signal is sent from a user by depressing the actuator button, and operation continues from step 102 as described above.

The message is maintained in memory while the mode selector switch is in the playback position. The actuator button is depressed to send an actuator signal to the processor, as shown at step 120. The processor retrieves the annunciator signals from the memory and sends them to the speaker, as depicted in step 122. At step 124, the speaker produces an audible signal from the annunciator signals to broadcast the message.

In a preferred embodiment of the present invention, the annunciator device is adapted to be disposed in close proximity to the user, such as on their person or in a pocket or object attached thereto. Users engaged in high-risk field operations, such as law enforcement and firefighting personnel, are likely to need assistance at a remote location. As described above, in such a context timely access to an "emergency contact" sheet may not be feasible. The annunciator device is attached to a badge carried by the user, or contained in a housing which includes both the badge and the annunciator device. In this manner, emergency personnel providing assistance are informed that the annunciator device is located with the badge of the user.

Figure 4A:
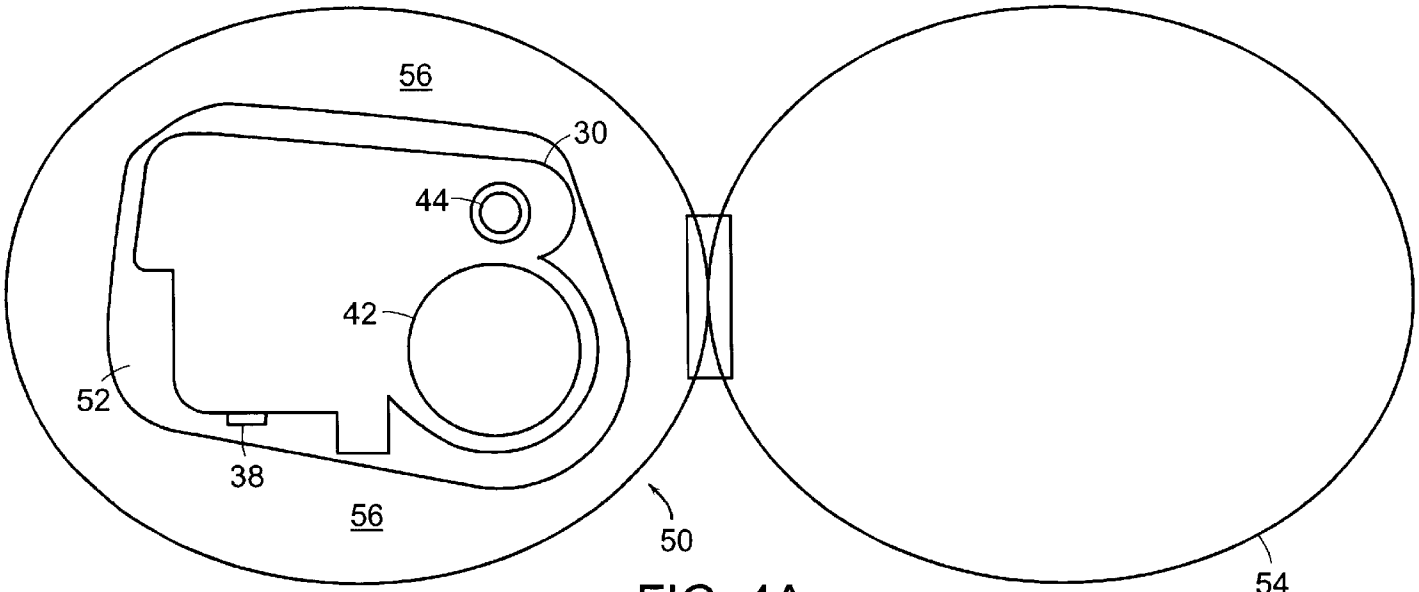
FIG. 4*a* shows an identification badge housing embodiment of the present invention.

The annunciator device is adapted to be contained in a variety of housings, as shown in FIGS. 4*a*–4*g*. In FIG. 4*a*, a badge housing as described above is shown. The badge housing 50 includes a cavity 52 adapted to contain the annunciator device 30. A cover 54 is hingedly attached to the housing, and can be fastened to the face 56 of the housing by any suitable means, such as via hook-and-loop fasteners. The actuator button 44 is accessible from the front of the housing 50 when the cover 54 is opened. The speaker 42 is also positioned so as to provide clear audible signals. The mode selector switch 38 is recessed in the cavity 52 so as to prevent accidental record operation and erasure of the annunciator signals in the memory.

Figure 4B:
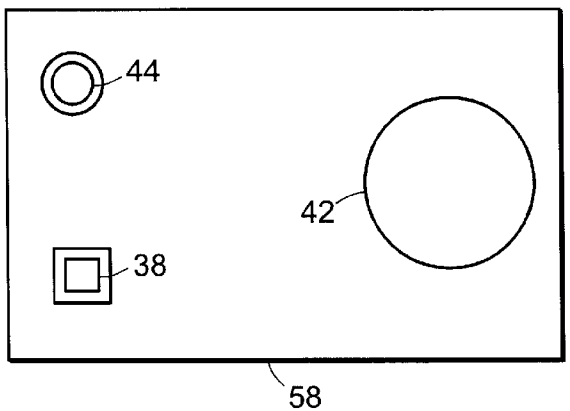
FIG. 4*b* shows a credit card housing embodiment of the present invention.
Figure 4C:
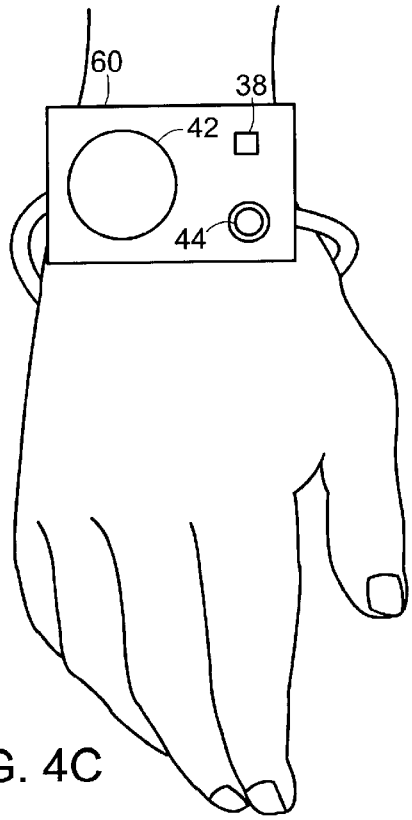
FIG. 4*c* shows a bracelet housing embodiment of the present invention.
Figure 4F:
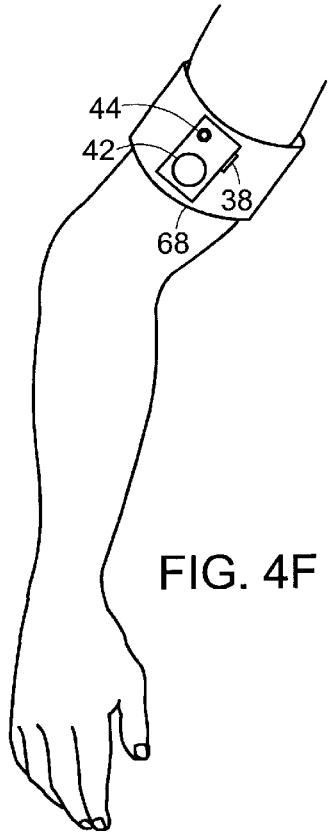
FIG. 4*f* shows an armband housing embodiment of the present invention.
Figure 4D:
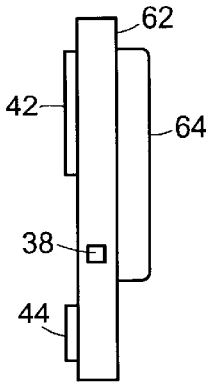
FIG. 4*d* shows a clip-on housing embodiment of the present invention.
Figure 4E:
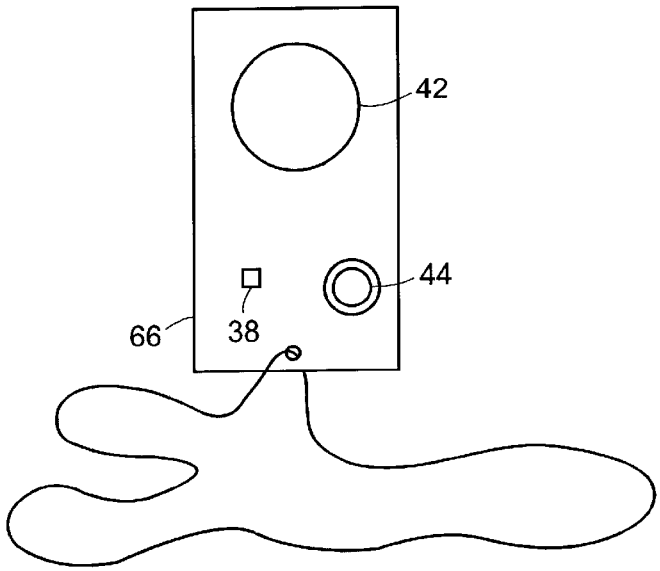
FIG. 4*e* shows an ID card and chain housing embodiment of the present invention.
Figure 4G:
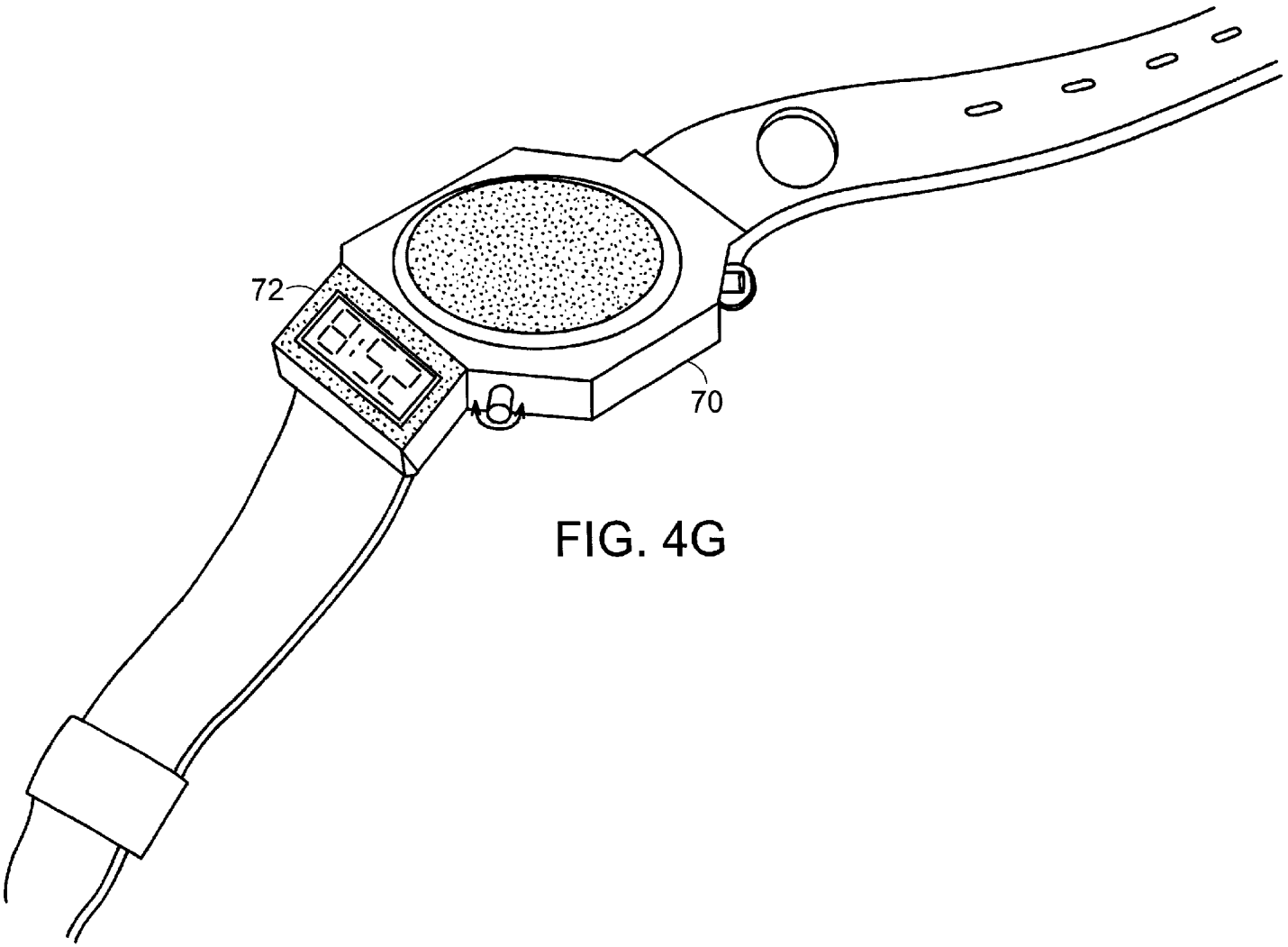
FIG. 4*g* shows a wristwatch housing embodiment of the present invention.

In FIG. 4*b*, a credit card housing 58 is shown. The actuator button 44, mode selector switch 38, and speaker 42 are accessible from a first side of the card 58. The mode selector switch 38 may be recessed to avoid accidental record operation. FIG. 4*c* shows a bracelet housing 60 which can be worn around the wrist of a user. FIG. 4*d* depicts a resilient clip housing 62. A resilient clip 64 allows attachment to any suitable surface, such as a belt, pocket, or handbag. Further, a resilient clip could be attached to the badge housing of FIG. 4*a*. A card chain housing 66 is shown in FIG. 4*e*. Employers often issue ID cards to allow appropriate access around the employer's site via a card reader disposed adjacent to an entryway or door. Employees often carry ID cards on a chain around the neck for convenient access to the card readers. FIG. 4*f* shows an armband housing 68 for wearing the annunciator device on the upper arm. FIG. 4*g* shows a wristwatch housing 70 having a display window 72 to show the time of day.

Alternate embodiments of the annunciator device provide other housings to suit a particular context. Configurations other than the embodiment disclosed in FIG. 2 allow the annunciator device to be disposed in any suitable housing. Alternate embodiments include messages directed to retail sales, allowing a customer to initiate broadcast of a message from a device in close proximity to a retail product. In a further embodiment the annunciator device can be carried by children for identification should they become lost. In another embodiment, the memory is an analog EEPROM, which provides enhanced memory longevity and resilience to voltage fluctuation, such as from battery changes, which can cause memory cell lockup compromising the annunciator signals. A further embodiment disposes a protective coating, such as a water resistant rubber or plastic sheet, over the circuit board to provide resistance to moisture and submersion.

While this invention has been particularly shown and described with references to preferred embodiments thereof, it will be understood by those skilled in the art that various changes in form and details may be made therein without departing from the scope of the invention encompassed by the appended claims.

What is claimed is:

1. An annunciator device for providing information about a user carrying the device, comprising:

a memory operable to store annunciator signals indicative of an emergency response message pertaining to a subject user carrying the device;

a power supply adapted to resiliently maintain said annunciator signals in said memory;

an output element operable to audibly produce the emergency response message in response to said annunciator signals;

a processor in communication with said memory and said output element and operable to retrieve said annunciator signals from said memory in response to an actuator signal and further operable to send said annunciator signals to said output element for rendering the emergency response message to assisting personnel seeking to assist the subject user, the annunciator device adapted to be disposed in a personal device housing of the subject user;

a unitary actuator in communication with said processor and operable by the assisting personnel to provide the actuator signal to said processor in a manner such that the emergency response message is rendered through the output element and enables the assisting personnel to assist the subject user, the subject user being distinct from the assisting personnel operating the unitary actuator; and means remote from the unitary actuator for identifying the location of the unitary actuator to assisting personnel.

2. The annunciator device of claim 1 further comprising an input element in communication with said processor, wherein said input element is operable at least by the subject user to provide said annunciator signals to said processor and said processor is further operable to store said annunciator signals in said memory.

3. The annunciator device of claim 2 wherein said input element is operable to provide said annunciator signals in response to a captured signal.

4. The annunciator device of claim 3 wherein said captured signal is an audible signal.

5. The annunciator device of claim 1 wherein said processor is further operable to retrieve and send said annunciator signals in response to said actuator signal.

6. The annunciator device of claim 5 further comprising a mode selector having a plurality of positions wherein said actuator is further operable to selectively provide said actuator signal to said processor when said mode selector is in a first position.

7. The annunciator device of claim 6 wherein said actuator is further operable to provide a record signal to said processor and said processor is further operable to store said annunciator signals in response to said record signal.

8. The annunciator device of claim 7 wherein said actuator is further operable to selectively provide said record signal when said mode selector is in a second position.

9. The annunciator device of claim 1 wherein said broadcast message is an audible signal.

10. The annunciator device of claim 9 wherein said output element is a speaker.

11. The annunciator device of claim 1 wherein said memory is an analog EEPROM.

12. The annunciator device of claim 1 further comprising a protective sheet shrinkably disposed on at least a portion of said annunciator device and adapted to prevent penetration of fluids to said annunciator device.

13. The annunciator device of claim 2 wherein said input element is a microphone.

14. The annunciator device of claim 3 further comprising an indicator LED operable to be energized when said input element is providing said annunciator signals to said processor.

15. The annunciator device of claim 1 wherein said annunciator device is disposed in a housing adapted to be worn in close proximity to a user.

16. The annunciator device of claim 15 wherein said housing is selected from the group consisting of an identification badge, an identification card, a resilient clip pocket, a pin-on pocket, a wristwatch, an armband, a credit card, a hook and loop mounted pocket, a chain mounted housing, and an elastic mounted pocket.

17. A method of selectively broadcasting an emergency response message about a user comprising:

storing, in a memory, annunciator signals indicative of an emergency response message pertaining to a subject user;

maintaining, via a power supply, said annunciator signals resiliently in said memory;

receiving, at a unitary actuator in communication with said memory, an external signal, the unitary actuator being identifiable by and operable by assisting personnel seeking to assist the subject user to provide the actuator signal;

providing, in response to said external signal, said actuator signal;

sending, in response to said actuator signal, said annunciator signals to an output element in communication with said memory; and audibly producing, via said output element, the emergency response message in response to said annunciator signals for rendering the emergency response message to the personnel seeking to assist the subject user such that the emergency response message enables the assisting personnel to assist the subject user, the memory, power supply, actuator, and output element adapted to be disposed in a personal device housing carried by the subject user; wherein the housing includes means remote from the unitary actuator for identifying the location of the unitary actuator.

18. The method of claim 17 wherein said storing further comprises:

receiving, at an input element, a record signal from an actuator;

receiving, via said input element, a captured signal in response to said record signal;

transforming, via said input element, annunciator signals in response to said captured signal; and sending, to said memory, said annunciator signals.

19. The method of claim 17 wherein said broadcasting comprises audible signals.

20. The method of claim 17 wherein said broadcasting comprises visible signals.

21. The method of claim 17 wherein said power supply is discontinuous and said memory maintains said annunciator signals during said discontinuity.

22. An annunciator device for record and playback of an emergency response message of a user carrying the device, the annunciator device comprising:

a memory operable to resiliently store annunciator signals indicative of the emergency response message, the emergency response message pertaining to a subject user having the device;

an output element operable to receive said annunciator signals and audibly produce the emergency response message in response to said annunciator signals;

a processor in communication with said memory and said output element and operable to retrieve and store said annunciator signals and further operable to send said annunciator signals to said output element in response to an actuator signal for rendering the emergency response message to assisting personnel seeking to assist the subject user;

an input element operable to receive said emergency response message and further operable to generate said annunciator signals and send said annunciator signals to said processor;

a unitary actuator operable to selectively send the actuator signal and a record signal to said processor, the actuator signal for rendering the emergency response message to the personnel seeking to assist the subject user such that the emergency response message enables the assisting personnel to assist the subject user; and a mode selector having a plurality of positions and operable to indicate which of said actuator signal and said record signal to send to said processor in response to said position;

wherein said input element sends said annunciator signals to said memory via said processor in response to said record signal when said mode selector is in a first position, and said output element receives said annunciator signals from said memory via said processor when said mode selector is in a second position;

the annunciator device adapted to be disposed in a personal device housing of the subject user and the housing having means remote from the unitary actuator for identifying the location of the unitary actuator to assisting personnel.

23. The annunciator device of claim 22 wherein said message is an audible message.

24. A computer program product having computer program code operable to selectively broadcast an emergency response message comprising:

computer program code for storing, in a memory, annunciator signals indicative of the emergency response message the emergency response message pertaining to a subject user;

computer program code for maintaining, via a power supply, said annunciator signals resiliently in said memory;

computer program code for receiving, at a unitary actuator operable by assisting personnel seeking to assist the subject user in communication with said memory, an actuator signal;

computer program code for sending, in response to said actuator signal, said annunciator signals to an output element in communication with said memory for rendering the emergency response message to the assisting personnel; and computer program code for broadcasting, via said output element, said emergency response message in response to said annunciator signals in a manner such that the emergency response message is rendered through the output element and enables the assisting personnel to assist the subject user;

the memory, power supply, actuator, and output element adapted to be disposed in a personal device housing of the subject user and the housing having means remote from the unitary actuator for identifying the location of the unitary actuator to assisting personnel.

25. The computer program product of claim 24 wherein said computer program code for storing further comprises:

computer program code for receiving, at an input element, a record signal from an actuator;

computer program code for receiving, via said input element, a captured signal in response to said record signal;

computer program code for transforming, via said input element, annunciator signals in response to said captured signal; and computer program code for sending, to said memory, said annunciator signals.

* * * * *